United States Patent [19]

Peyre

[11] Patent Number: 4,765,641

[45] Date of Patent: Aug. 23, 1988

[54] SAFETY SKI BINDING

[75] Inventor: Henri Peyre, St Benin D'Azy, France

[73] Assignee: Sté Look, Nevers, France

[21] Appl. No.: 34,921

[22] Filed: Apr. 6, 1987

[30] Foreign Application Priority Data

Apr. 8, 1986 [FR] France ..... 86 04970

[51] Int. Cl.[4] ..... A63C 9/08

[52] U.S. Cl. ..... 280/628; 280/634

[58] Field of Search ..... 280/628, 626, 634, 629, 280/625, 633; 384/38

[56] References Cited

U.S. PATENT DOCUMENTS

| | | | |
|---|---|---|---|
| 2,062,862 | 12/1936 | Calame | 384/38 |
| 4,345,776 | 8/1982 | Salomon | 280/626 |
| 4,405,153 | 9/1983 | Salomon | 280/634 |
| 4,592,569 | 6/1986 | Nowak et al. | 280/625 |
| 4,639,011 | 1/1987 | Rullier | 280/628 |
| 4,682,786 | 7/1987 | Peyre et al. | 280/628 |

FOREIGN PATENT DOCUMENTS

| | | | |
|---|---|---|---|
| 347308 | 12/1975 | Austria . | |
| 1923038 | 2/1971 | Fed. Rep. of Germany . | |
| 2448769 | 4/1976 | Fed. Rep. of Germany . | |
| 2314742 | 1/1977 | France . | |
| 2395046 | 1/1979 | France . | |
| 2439601 | 5/1980 | France . | |
| 2533833 | 4/1984 | France . | |
| 2004956 | 4/1979 | United Kingdom | 384/38 |

*Primary Examiner*—David M. Mitchell

*Attorney, Agent, or Firm*—Oblon, Fisher, Spivak, McClelland & Maier

[57] ABSTRACT

A resilient mechanism for maintaining the jaw unit of a safety ski binding in the normal boot-retaining position includes two vertical flat faces extending transversely on a stationary jaw-unit support. Two flat cams applied against the flat faces by a single spring consist respectively of a bearing surface of the jaw-unit body and of a small bearing plate carried by a rod on which the jaw-unit body is slidably mounted. The rod is slidably mounted within a knuckle-bearing orifice of the stationary support and is thus capable of pivotal displacement with the jaw unit in all directions on the stationary support.

8 Claims, 4 Drawing Sheets

SAFETY SKI BINDING

BACKGROUND OF THE INVENTION

1. Field of the Invention

The present invention relates to safety ski bindings which are adapted to lock the toe end of a ski boot in position so as to constitute a toe abutment device.

In more precise terms, the invention relates to toe abutment devices of the so-called "multidirectional-trip" type comprising a boot-retaining jaw unit mounted for pivotal displacement in different directions, a resilient retaining mechanism being provided for maintaining the jaw unit in its normal position.

Thus, in the event of a torsional stress exerted on the skier's foot, the jaw unit is capable of lateral displacement in order to permit disengagement of the ski boot. However, the jaw unit is also capable of upward displacement so as to permit disengagement of the ski boot in this direction in the event of a backwardfall movement of the skier. It may be added that, in some types of toe abutment device, the jaw unit is mounted so as to be capable of displacement in all directions in order to disengage the ski boot under optimum conditions in the event of a complex fall that is to say, a falling movement in which a twisting effort is combined with an upward extension effort or else in the event of a backward fall accompanies by a twisting effort.

2. Description of the Prior Art

In order to achieve a satisfactory standard of safety, certain types of toe-binding abutment devices are so designed that a forward thrust exerted on the ski boot and caused by an incipient forward fall, for example, produces a reduction in the elastic resistance acting in opposition to rotational displacement of the body of the corresponding toe-abutment device. In point of fact, this forward thrust has the effect of increasing the friction forces set up by the ski boot and consequently of increasing the stiffness of ski-boot release. It is therefore necessary to reduce the elastic resistance of the boot-retaining mechanism in order to ensure that the magnitude of the retaining force remains substantially the same.

Thus, French Pat. No. 2,395,046 describes a toe-abutment device in which the boot-retaining jaw unit is mounted for axial sliding motion on the rotary body of the jaw unit in such a manner as to produce a reduction in torsional elastic resistance in the event that a thrust is exerted on said jaw unit in the forward direction. The resilient mechanism provided in this abutment device consists of a piston which is housed within the rotary body and is applied by a spring against a flat face formed on the pivot of said rotary body. The piston is adapted to carry two lateral extensions placed on each side of the pivot, and the boot-retaining jaw unit is intended to produce action on the ends of the extensions in the event of forward displacement of the unit. This accordingly has the effect of moving the piston away from the flat face which normally serves as a bearing surface for the piston and thus of permitting free rotational displacement of the abutment body.

In the event of a forward fall, the ski boot is therefore completely released. However, such an abrupt release constitutes a potential hazard. Furthermore, the toe-abutment device described in the cited patent does not in any way permit release of the ski boot in the event of a backward fall. A fortiori, no arrangements are therefore made to reduce elastic resistance to rotational displacement in the event of a backward fall.

French Pat. No. 2,439,601 describes a ski binding which can constitute both a heel-holding device and a toe-abutment device. This ski binding is so designed as to permit upward release of the corresponding end of the ski boot, which is not the case with the toe-abutment device mentioned earlier. To this end, the ski binding described in the second patent comprises an endpiece which is capable of upward pivotal displacement and which is carried by a body, the body being in turn rotatably mounted on a pivot which is perpendicular to the ski. This pivot has two flat faces which are oriented in opposite directions and against which are applied respectively a bearing surface formed in the end-wall of the rotary body and a piston mounted within the rotary body, a single spring being applied against the piston. The corresponding jaw unit is pivotally mounted directly on the rotary body of the ski binding about a transverse axis parallel to the top surface of the ski. However, the jaw unit is maintained in its normal position by a cross-pin interposed between the end-wall of the rotary body and the corresponding flat face of the pivot, the opposite ends of the cross-pin being adapted to cooperate with guide ramps provided on the jaw unit.

When this ski binding is employed as a toe-abutment device, the arrangement described in the foregoing produces a reduction in elastic resistance to torsion in the event of a backward fall of the skier, whereas a forward fall produces no such reduction. In actual practice, however, many of the falls experienced by skiers correspond to a complex movement of falling forward and twisting. When this occurs, it is essential to provide for a reduction in the resistance which acts in opposition to rotational displacement.

Furthermore, the arrangement provided in the ski binding considered is relatively complex, thereby imposing a heavy cost penalty.

OBJECT OF THE INVENTION

It is for the reasons given above that the aim of the present invention is to provide a multidirectional-trip toe abutment device so designed as to be capable of releasing the toe end of the ski boot under the best possible conditions of safety in any of the various types of fall which are liable to occur. Moreover, the design concept of this toe abutment device is such that its arrangement and structure are much more simple than in multidirectional-trip toe abutment devices of existing types.

SUMMARY OF THE INVENTION

To this end, the toe abutment device under consideration has a boot-retaining jaw unit for securing the toe end of a ski boot, the jaw unit being pivotally mounted on a stationary support and being maintained in its normal position by a resilient mechanism which includes two vertical flat faces formed on the support in opposite directions in transverse planes. Two flat cams are applied against the flat faces by means of a single spring, the cams being constituted respectively by a bearing surface formed on the movable body of the jaw unit and by a bearing member carried by a part subjected to the action of the spring. The toe abutment device in accordance with the present invention is distinguished by the following features:

the aforesaid bearing member which is applied against the rearwardly oriented stationary flat face consists of a plate carried by the rear end of a rod on which the body of the boot-retaining jaw unit is slidably mounted; and the rod traverses the stationary support through an orifice of larger cross-section and is adapted to carry a knuckle bearing slidably mounted on the rod at the orifice location so as to permit pivotal displacement of the rod and consequently of the boot-retaining jaw unit on the stationary support in all directions.

Thus the structure of the toe abutment device in accordance with the invention is extremely simple, while being nevertheless capable of releasing the toe end of the ski boot in all desired directions under the best possible conditions for ensuring a high standard of safety. It should be noted in this connection that the arrangement contemplated by the invention makes it possible to provide bearing plates and cams having portions of different width in order to ensure that the elastic resistance acting in opposition to displacements of the boot-retaining jaw unit is of different value according to the type of motion to which the jaw unit is subjected. Moreover, in the event of a forward fall, the resistance to lateral release is reduced by the fact that the thrust exerted by the ski boot on the jaw unit causes backward displacement of the jaw unit while relieving the pressure exerted by the jaw unit on the corresponding flat face of the stationary support.

DESCRIPTION OF THE PREFERRED EMBODIMENTS

The First Embodiment

Figure 1:
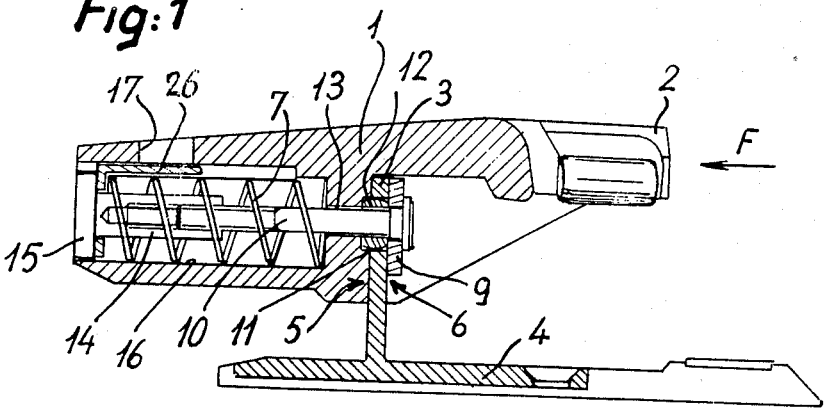
FIG. 1 is an axial vertical sectional view of a first embodiment of the toe abutment device in accordance with the invention shown in its normal position.

In the example shown in FIGS. 1 to 6, the toe abutment device in accordance with the invention includes a boot-retaining jaw unit, the movable body of which is designated by the general reference numeral 1. The rear end of the jaw-unit body 1 is adapted to carry two arms 2. The two arms 2 are intended to be placed on each side of the toe end of the ski boot to be locked in position. The front portion of the jaw-unit body 1 contains the different elements of the resilient mechanism for locking it in its normal postion.

The boot-retaining jaw unit is movably mounted on a stationary support consisting of a plate 3 carried by a mounting base-plate 4. The mounting base-plate 4 is intended to be fixed on the top surface of a ski by means of screws, for example. The support plate 3 extends at right angles to the mounting base-plate 4 so that, after assembly, it is consequently located at right angles to the surface of the ski. Moreover, both faces 5 and 6 of the support plate 3 are accordingly disposed in planes which are transverse to the axis X-Y of the jaw unit and therefore perpendicular to the longitudinal axis of the ski after assembly.

The two faces 5, 6 of the support plate 3 constitute two flats forming part of the resilient mechanism which has the function of maintaining the body 1 of the jaw unit in its normal position. This mechanism also includes two flat cams which are applied against the aforementioned flat faces 5, 6 by means of a single coil spring 7. One of these cams is constituted by a bearing surface 8 which is formed on the body 1 of the boot-retaining jaw unit and which is oriented towards the rear (or, in other words, towards the ski-boot location) in order to be applied against the flat face 5 of the support plate, the flat face 5 being oriented in the forward direction.

In regard to the other flat cam, this cam is constituted by a small plate 9 which is placed so as to be applied against the rearwardly oriented flat face 6. The small plate 9 is carried by the rear end of a rod 10 which is in turn carried by the body 1 of the boot-retaining jaw unit. The rod 10 is engaged through a hole 11 having a much larger cross-sectional area than the rod 10. The hole 11 is formed in the stationary support plate 3. At this location, the rod 10 is adapted to carry a bearing knuckle 12 placed within the hole 11 so as to permit pivotal displacement fo the rod 10 in all directions. In consequence, the rod 10 has the function of retaining the body 1 of the jaw unit on the stationary plate 3, while at the same time permitting pivotal displacement of the body 1 in all directions.

In addition, the jaw-unit body 1 is capable of sliding on the rod 10, which is engaged within a bore 13 formed in the body 1.

Furthermore, the front end of the rod 10 is engaged within a cylindrical sleeve 14 carried by an endplug 15 which closes the front end of a cavity 16. The cavity 16 formed within the body 1 is intended to serve as a housing for the rod 10 as well as the coil spring 7, which is placed around the rod 10.

The aforementioned coil spring 7 is thus interposed between the end-wall of the cavity 16 and the endplug 15. It should be noted that the cylindrical sleeve 14 carried by the end-plug 15 is engaged by screwing on the corresponding end portion of the rod 10. Under these conditions, the coil spring 7 has the simultaneous function of applying teh bearing surface 8 against the front flat face 5 and applying the small bearing plate 9 against the rear flat face 6.

The pressure which is thus exerted can be adjusted by compressing the spring 7 to a greater or lesser extent, this being achieved by screwing the end-plug 15 and the cylindrical sleeve 14 on the corresponding end portion of the rod 10. The end-plug 15 is preferably adapted to carry an adjustment-indicating index 26 which appears behind a window 17 of the jaw-unit body 1.

The length of the small bearing plate 9 along its top edge 18 is distinctly smaller than the length of its bottom edge 19 or, in other words, the edge which is directed towards the mounting base-plate 4. To this end, in the example shown in FIG. 4, the upper portion of the small bearing plate 9 has the shape of a trapezoid whose short base is located at the top.

Figure 3:
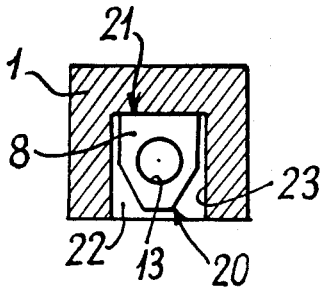
FIG. 3 is a transverse sectional view of the body of the boot-retaining jaw unit, this view being taken along line III—III of FIG. 2.
Figure 4:
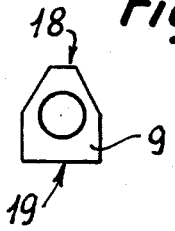
FIG. 4 is a view in elevation showing the small bearing plate carried by the rod which is engaged through the stationary support.
Figure 5:
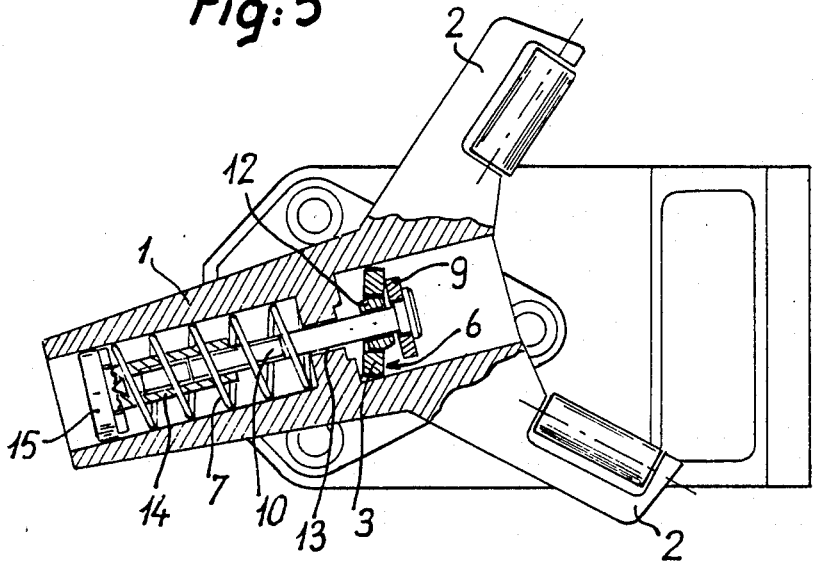
FIG. 5 is a view which is similar to FIG. 2 and illustrates the toe abutment device considered at the time of rotational displacement of its boot-retaining jaw unit under the action of simple torsional stress.
Figure 6:
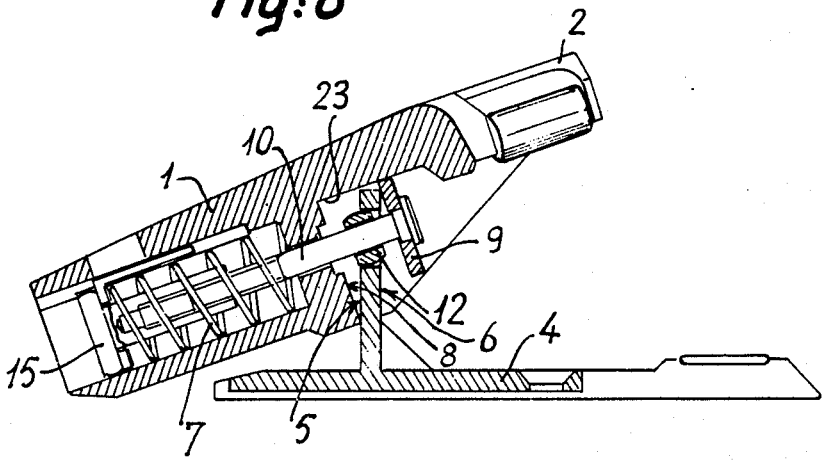
FIG. 6 is a view which is similar to FIG. 1 and illustrates the toe abutment device considered at the time of upward displacement of its jaw unit under the action of a backward fall.

In regard to the bearing surface 8 formed on the body 1 of the jaw unit, the bottom edge 20 of the bearing surface 8 is shorter than its top edge 21. In accordance with an arrangement which is approximately symmetrical with the arrangement provided for the small bearing plate 9, the lower portion of the bearing surface 8 has a trapezoidal contour, the short base of which is oriented downwards (as shown in FIG. 3).

It is worthy of note that the bearing surface 8 is materialized in the form of a flat, slightly raised protuberance on the forward wall 22 of a cavity 23 which is formed in the corresponding portion of the jaw-unit body 1 and in which are housed the vertical support plate 3 as well as the small bearing plate 9. The bearing surface 8 is in fact located in a plane at right angles to the axis of the bore 13 and is intended to be placed normally in a plane which is transverse to the ski and perpendicular to the top surface of the ski.

Figure 2:
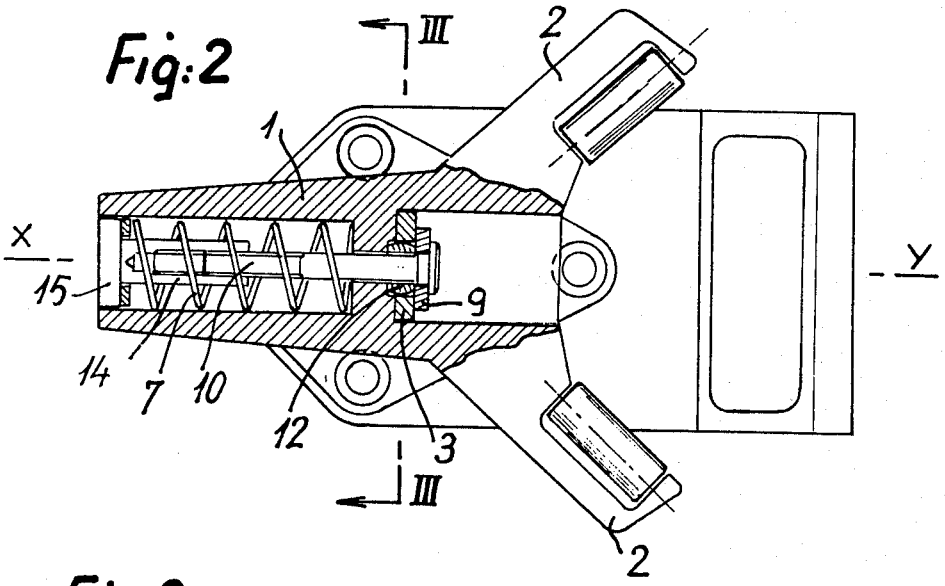
FIG. 2 is an overhead plan view of the first embodiment with a portion broken away so as to reveal the resilient mechanism provided in the toe abutment device.

When no abnormal stresses are exerted on the ski boot, application of the two flat cams 8 and 9 against the corresponding flat faces 5 and 6 ensures that the boot-retaining jaw unit 1 is maintained in its normal position as shown in FIGS. 1 and 2.

In the event of abnormal stresses exerted on the ski boot, the operation of the toe abutment device under consideration is as follows:

(1)—In the event of excessive torsional stress (FIG. 5):

In such a case, the jaw unit is capable of moving to one side by pivotal displacement of the rod 10 within the hole 11 of the stationary support plate 3 through the agency of the knuckle bearing 12. The body 1 of the jaw unit then carries out a pivotal movement in a horizontal plane just as if the body 1 were mounted to rotate about a vertical axis. This causes the two bearing cams 8 and 9 to assume oblique positions with respect to the corresponding flat faces 5 and 6 and then to be applied against the flat faces 5 and 6 along each of the lateral edges which limit their portions of greater width.

Under these conditions, the rod 10 is displaced in sliding motion within the knuckle bearing 12, and the body 1 of the jaw unit in turn slides along the rod, thereby compressing the spring 7.

In consequence, as soon as torsional stress is no longer exerted, the jaw-unit body 1 tends to return automatically to its normal position.

(2)—In the event of a forward fall which may be accompanied by torsional stress:

In this instance, the ski boot is caused to exert a forward thrust on the jaw-unit body 1 in the direction of the arrow F, thus producing displacement of the body 1 in sliding motion on the rod 10. This accordingly has the effect of relieving the pressure exerted by the bearing surface 8 on the corresponding flat face 5.

Under these conditions, if the forward fall is accompanied by torsional stress, the elastic resistance to rotational displacement of the jaw-unit body 1 is accordingly reduced precisely as a result of the pressure relief. In consequence, this effectively ensures a reduction in resistance to rotational displacement, which is necessary in the event that the skier experiences a forward fall.

A point worthy of note in this connection is that the mode of multidirectional pivotal mounting of the jaw-unit body 1 on its stationary support consisting of the plate 3 permits displacement of the body 1 in any desired orientation for the purpose of releasing the ski boot under optimum conditions, irrespective of the orientation of the stress sustained by the skier's foot.

(3)—In the event of a simple backward fall (FIG. 6):

In this case the body 1 of the boot-retaining jaw unit is displaced in an upward pivotal movement just as if it were pivotally mounted about a horizontal axis. As will be readily apparent, this movement is carried out in practice by means of the knuckle bearing 12 which is employed for pivotally mounting the rod 10 within the hole 11 in the plate 3.

The two bearing cams 8 and 9 are accordingly constrained to take up oblique positions with respect to the corresponding flat faces 5 and 6. The result thereby achieved is that the small plate 9 is applied against the flat face 6 along its top edge 18, whereas the bearing surface 8 is applied against the flat face 5 along its bottom edge 20.

As in the case of torsional stress, the pressures thus exerted subsequently tend to restore the body of the toe abutment device to its normal position.

(4)—In the event of a backward fall accompanied by torsional stress:

As mentioned in the foregoing, the result of an upward displacement of the jaw-unit body 1 is that the small plate 9 is applied against the corresponding flat face 6 by means of its top edge 18, whilst the bearing surface 8 is applied against the flat face 5 along its bottom edge 20. Now in the case of both plates, the edge considered is the horizontal edge which has the smaller length.

In consequence, if a backward-fall movement is accompanied by torsional stress, the elastic resistance to rotational displacement of the jaw-unit body 1 is lower than in the case of simple torsional stress. In fact, the length of the lever-arm applied by the two cams 8 and 9 against the flat faces 5 and 6 is accordingly reduced, since each lever-arm is virtually constituted by the top edge 18 of the small plate 9 and by the bottom edge 20 of the bearing surface 8, respectively. In consequence, this accordingly achieves an effective reduction in resistance to rotational displacement, which is necessary in the event that the skier experiences a backward fall.

In the final analysis, the toe abutment device in accordance with the invention guarantees that the corresponding ski boot will be released under optimum conditions of safety in the different abnormal situations which have been considered in the foregoing and which arise from excessive stresses exerted on a skier's foot or leg. This advantageous result is obtained by means of a very simple structural design of the corresponding toe abutment device which may accordingly be produced at low cost and which offers the best possible conditions of operational safety.

Although the abutment device in accordance with the invention is of the type in which the boot-retaining jaw unit is mounted for pivotal displacement in all directions about a knuckle bearing, the distinctive design concept of the system considered permits an arrangement of bearing cams and plates which sets up an elastic resistance in opposition to the displacement of the boot-retaining jaw unit, the value of the resistance being different according to the nature of the movement to which the jaw unit is subjected. This is due to the fact that, instead of providing a stationary knuckle bearing and forming the flat bearing faces of the cams of the resilient system directly on the knuckle bearing as in the case of ski bindings of the type at present in use, provision is made for a knuckle bearing which is independent of the stationary jaw-unit support and which is slidably mounted on the rod 10, the boot-retaining jaw unit being slidably mounted on the rod. Furthermore, the fact that the knuckle bearing is slidably mounted on the rod offers an advantage in that the displacement of the rod 10 in sliding motion within the orifice 11 is not liable to cause any disturbance in the conditions of pivotal displacement of the jaw-unit body on the stationary jaw-unit support. The arrangement thus offers a further advantage in that the point of articulation of the jaw-unit body is located at a suitable intermediate level which permits displacement of the jaw unit along a satisfactory path of travel for ensuring that the ski boot is released under good conditions, especially in the event of a backward fall.

The Second Embodiment

Figure 7:
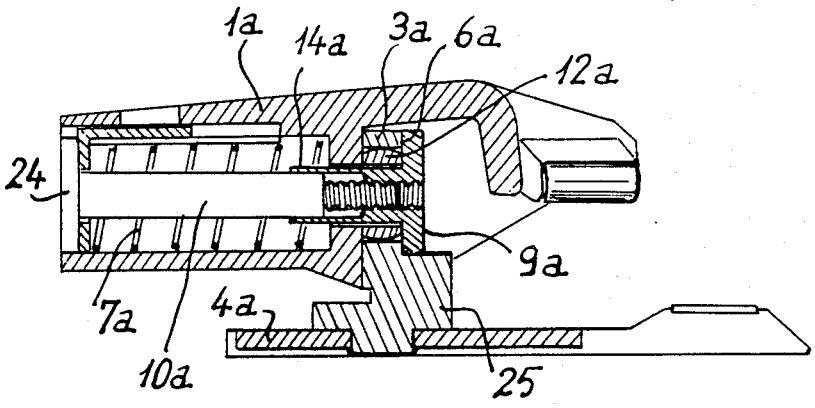
FIGS. 7 and 8 are views which are similar to FIGS. 1 and 2 but which illustrate a second embodiment of the invention.
Figure 8:
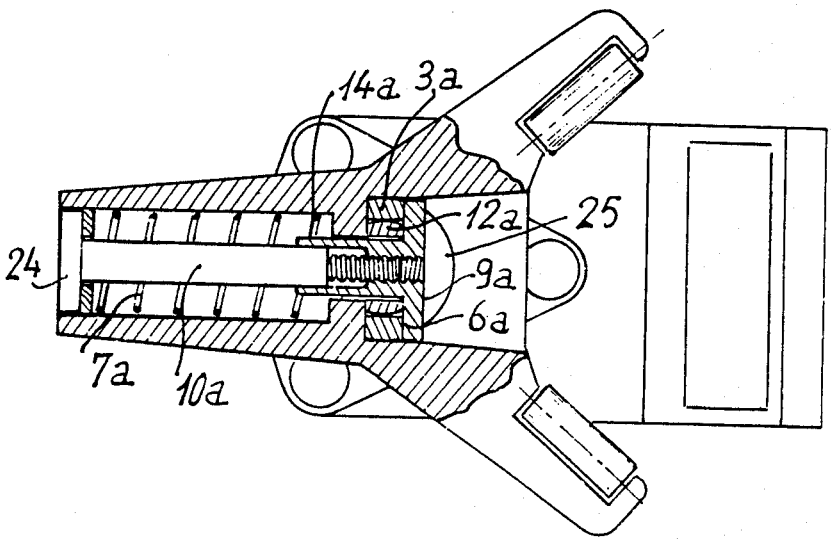

FIGS. 7 and 8 illustrate a variant of the embodiment described above. It will in any case be understood that the general design of this toe abutment device is the same as that of the foregoing embodiment. In consequence, the elements and components which correspond to those of the preceding embodiment are designated in FIGS. 7 and 8 by the same reference numerals followed by the index a.

This toe abutment device differs from the preceding essentially in the fact that the end-plug 15 for adjusting the initial compression of the spring 7 is suppressed, this adjustment being performed in this case by screwing the front end of the corresponding rod 10*a* within an internally-threaded sleeve 14*a* carried by the small plate 9*a* which is applied against the rear flat face 6*a* of the stationary support plate 3*a*. The front end of the rod 10*a* is consequently adapted to carry an operating head 24 which is accessible from the exterior and serves to engage the rod 10*a* within the sleeve 14*a* by screwing in order to compress the corresponding spring 7*a* to a greater or lesser extent.

However, the operation remains exactly the same as before, since the rear small plate 9*a* remains rigidly fixed to the rod 10*a* and moves with the rod 10*a* with respect to the body 1*a* of the corresponding jaw unit.

Figure 9:
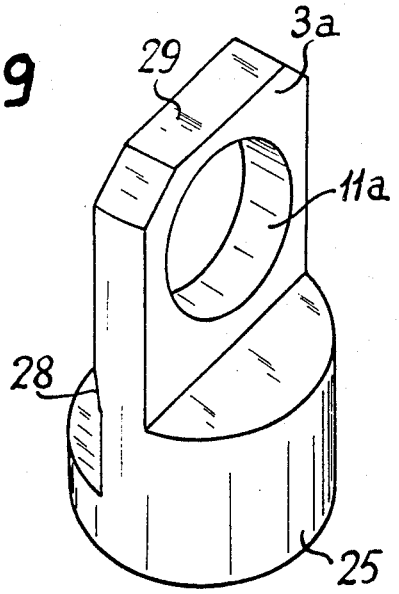
FIG. 9 is a perspective view showing the stationary support of the movable jaw unit of the corresponding toe abutment device.
Figure 10:
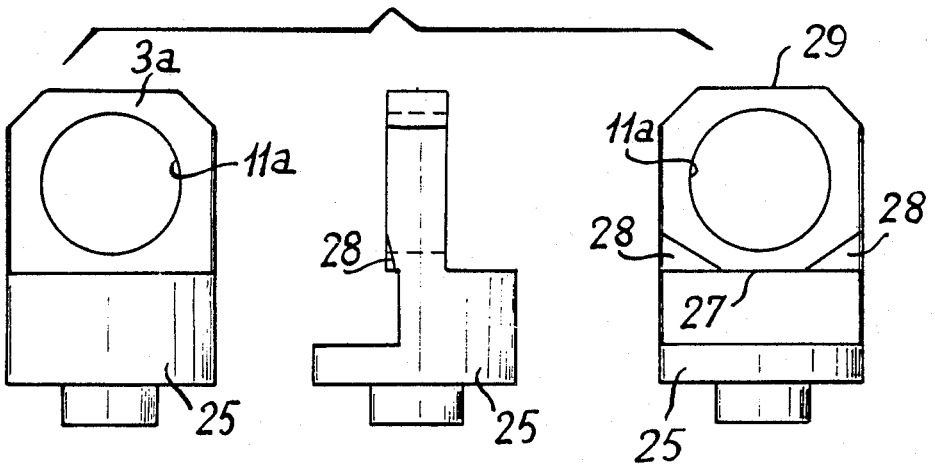
FIGS. 10 are views in elevation showing respectively the rear face, the side, and the front face of the stationary support.

There is, however, another difference in detail design which arises from the difference mentioned above namely, the fact that the knuckle bearing 12*a* is carried by the sleeve 14*a*, which is rigidly fixed to the rear cam (i.e., the small plate 9*a*) and is no longer carried directly by the rod 10*a*. It is apparent, however, that this detail does not in any way affect the operation of the device. Furthermore, the vertical plate 3*a* which serves as a support for the boot-retaining jaw unit has a support base 25 of larger cross-section which is riveted on the mounting base-plate 4*a* of the jaw unit. This distinctive structural design of the corresponding component is apparent from FIGS. 9 and 10. As can be observed on the right-hand side of FIG. 10, the front face of the vertical support plate 3*a* is so designed as to form a cam having a different action according to the orientation of motion of the movable jaw. In fact, the top edge 26 of the front face is of greater width than its bottom edge 27, and small cant faces 28 are formed on each side of the bottom edge 27.

It is readily apparent that many modifications and variants of the toe abutment device in accordance with the invention may be considered. For instance, instead of being made of metal, the boot-retaining jaw unit can be formed of plastic material while making provision for a small metal plate at the bottom of the cavity 23 in order to constitute the bearing surface 8 which bears against the front flat face 5.

What is claimed is:

1. A safety ski binding which comprises:

(a) a movable toe-abutment body which, in use, contacts the skier's boot, said movable toe-abutment body being slidably mounted on a longitudinal rod for longitudinal displacement relative to said longitudinal rod, said longitudinal rod serving as a support for said movable toe-abutment body;

(b) a knuckle-joint in which said longitudinal rod is mounted so as to be capable of displacement in sliding motion through said knuckle-joint and in pivotal motion by means of said knuckle-joint within an orifice formed in a stationary support so that said movable toe-abutment body is free to undergo pivotal displacements relative to said stationary support in all directions;

(c) two vertical flat faces formed in transverse planes rspectively on the rear side and on the front side of said stationary support;

(d) a first flat cam applied against the front flat face of said stationary support, said first flat cam comprising a bearing surface which is provided on said movable toe-abutment body and which is oriented in a rearward direction;

(e) a second flat cam carried by the rear end of said longitudinal rod and applied against the rear flat face of said stationary support; and (f) an end member which is carried by the front end of said longitudinal rod, the pressure of a spring being exerted on said end member in the forward direction and on said movable toe-abutment body in the rearward direction.

2. A ski binding according to claim 1 wherein said stationary support comprises a support plate which is perpendicular to a mounting base-plate, the front and rear faces provided on said stationary support being constituted by the front and rear faces of said support plate.

3. A ski binding according to claim 1 wherein said second flat cam comprises a small bearing plate carried by said longitudinal rod, said small bearing plate having a width which is smaller along its top edge than along its bottom edge, whereas said bearing surface has a width which is smaller along its bottom edge than along its top edge.

4. A ski binding according to claim 2 wherein said bearing surface comprises a raised portion on the forward wall of a cavity which is formed in the corresponding portion of said movable toe-abutment body and which contains said support plate as well as said second flat cam.

5. A ski binding according to claim 1 wherein:

(a) said second flat cam is comprised by a small bearing plate carried by said longitudinal rod;

(b) said longitudinal rod together with said small bearing plate is slidably mounted within a bore formed in said movable toe-abutment body; and (c) the front end of said longitudinal rod is held in position by said end member, which closes the front end of a cavity which is provided within said movable toe-abutment body and serves as a housing for said longitudinal rod and said spring.

6. A ski binding according to claim 5 wherein said small bearing plate is carried by a sleeve screwed on the corresponding end portion of said longitudinal rod, the opposite end of said longitudinal rod being adapted to carry said end member, said end member being adapted for adjusting the initial compression of said spring by rotational displacement of said end member.

7. A ski binding according to claim 5 wherein said end member is an end-plug.

8. A ski binding according to claim 5 wherein said end member is an operating head.

* * * * *